US011020748B2

(12) United States Patent
Tagawa et al.

(10) Patent No.: US 11,020,748 B2
(45) Date of Patent: Jun. 1, 2021

(54) METHOD AND APPARATUS FOR CONTROLLING MILLING ROLL MACHINE

(71) Applicant: SATAKE CORPORATION, Tokyo (JP)

(72) Inventors: Sumio Tagawa, Tokyo (JP); Ryo Yokoyama, Tokyo (JP)

(73) Assignee: SATAKE CORPORATION, Tokyo (JP)

( * ) Notice: Subject to any disclaimer, the term of this patent is extended or adjusted under 35 U.S.C. 154(b) by 250 days.

(21) Appl. No.: 16/323,792

(22) PCT Filed: Aug. 8, 2017

(86) PCT No.: PCT/JP2017/028723

§ 371 (c)(1),
(2) Date: Feb. 7, 2019

(87) PCT Pub. No.: WO2018/030387

PCT Pub. Date: Feb. 15, 2018

(65) Prior Publication Data

US 2019/0176158 A1 Jun. 13, 2019

(30) Foreign Application Priority Data

Aug. 10, 2016 (JP) ..... JP2016-157224

(51) Int. Cl.

| | |
|---|---|
| ***B02C 25/00*** | (2006.01) |
| ***B02C 4/32*** | (2006.01) |
| ***B02B 5/02*** | (2006.01) |
| ***B02B 7/02*** | (2006.01) |

(Continued)

(52) U.S. Cl.

CPC ..... *B02C 4/32* (2013.01); *B02B 5/02* (2013.01); *B02B 7/02* (2013.01); *B02C 4/06* (2013.01); *B02C 4/38* (2013.01); *B02C 25/00* (2013.01)

(58) Field of Classification Search

CPC .. B02C 25/00; B02C 4/06; B02C 4/32; B02C 4/38

See application file for complete search history.

(56) References Cited

U.S. PATENT DOCUMENTS 4,140,285 A * 2/1979 Linzberger ..... B02C 4/38 241/232
5,379,950 A * 1/1995 Kuster ..... A23G 1/12 241/159

(Continued)

FOREIGN PATENT DOCUMENTS

CN 105324177 A 2/2016
DE 19819614 A1 11/1999

(Continued)

OTHER PUBLICATIONS

Extended European Search Report dated Feb. 19, 2020 in European Patent Application No. 17839457.3.

(Continued)

*Primary Examiner* — Faye Francis

(74) *Attorney, Agent, or Firm* — Faegre Drinker Biddle & Reath LLP

(57) ABSTRACT

A method and an apparatus for controlling a milling roll machine capable of accurately monitoring a surface temperature of a roll and preventing a high temperature abnormality occurring on a roll surface from being overlooked are provided A temperature sensor S that monitors surface temperatures of a pair of rolls 4 and 5 and a temperature of a milled product after passing through the rolls is provided in the vicinity of the pair of rolls 4 and 5, and opening/closing control of the gap between the rolls 4 and 5 or flow rate control of the raw material stock is performed according to the surface temperatures of the rolls and the temperature of the milled product after passing through the rolls detected by the temperature sensor S.

11 Claims, 8 Drawing Sheets

(51) Int. Cl.
*B02C 4/06* (2006.01)
*B02C 4/38* (2006.01)

(56) References Cited

U.S. PATENT DOCUMENTS

| | | | | |
|---|---|---|---|---|
| 5,673,864 | A | 10/1997 | Stevenson et al. | |
| 6,732,963 | B2 * | 5/2004 | Kasada | B02C 4/06 241/135 |
| 2016/0067713 | A1 | 3/2016 | Okamoto et al. | |
| 2016/0107162 | A1 * | 4/2016 | Busenhart | B02C 25/00 241/25 |
| 2019/0240672 | A1 * | 8/2019 | Reiter | B02C 4/32 |

FOREIGN PATENT DOCUMENTS

| | | | |
|---|---|---|---|
| DE | 102012000022 | A1 | 7/2013 |
| JP | S53-11757 | A | 2/1978 |
| JP | H02-111448 | A | 4/1990 |
| JP | H04-131145 | A | 5/1992 |
| JP | H06-218294 | A | 8/1994 |
| JP | 3562541 | B2 | 9/2004 |
| JP | 2005-262223 | A | 9/2005 |
| JP | 2015-180530 | A | 10/2015 |

OTHER PUBLICATIONS

The Notification of the First Office Action dated Jun. 22, 2020 in Chinese Patent Application No. 201780048959.4 (9 pages) with an English translation (11 pages).
Thomas Heierli, "Advanced & New Technologies in Grain Milling," [on line] Oct. 13, 2014, IAOM 2014 Kuala Lumpur, pp. 16-17.

* cited by examiner

METHOD AND APPARATUS FOR CONTROLLING MILLING ROLL MACHINE

CROSS REFERENCE TO PRIOR APPLICATIONS

This application is the National Stage of International Application No. PCT/JP2017/028723 filed Aug. 8, 2017 and claims benefit of Japanese Application No. 2016-157224 filed on Aug. 10, 2016, which are herein incorporated by reference in their entirety.

TECHNICAL FIELD

The present invention relates to a method and an apparatus for controlling a milling roll machine.

BACKGROUND ART

Many milling roll machines for grinding and splitting are installed in a flour mill for milling grain such as wheat. In order to improve quality of ground or split products, the milling roll machines are given conditions determined in regards to supply of products or raw materials, fine adjustment or the like, and provided with control means for monitoring the products or raw materials all the time during a grinding operation or after a grinding process and changing adjustment values when differences arise in a standard value (e.g., Patent Literature 1).

For example, Patent Literature 1 describes "the determined conditions include a great many influencing factors, temperature, humidity, feed timing and heating of the whole machine or the like. . . . (snip) . . . In a very early period, sensuous testing methods were reevaluated or even partially demanded. This might be one of main reasons that a years-long well-known hope of automating all the milling processes could not actually be realized."

An embodiment in the above-described document describes "a temperature sensor(s) is/are attached on one side or both sides of at least one roll so as to correct dimensional deviations under influences of temperature. A temperature controller is attached to the temperature sensor. By so doing, a target value is corrected by one temperature factor. This process can also be executed at an interval. . . . (snip) . . . In this way, the target value is also corrected. Influences of temperature are automatically corrected and all the other factors affecting the grinding result are monitored and measured using a conventional well-known method and can be manually supplied."

That is, according to Patent Literature 1, a temperature sensor is attached to a bearing casing of one or two rollers of a set of rollers, a temperature of a grinding roller is measured and an interval target value is corrected as a temperature factor, and it is possible to improve quality of a ground or split product by performing correction control through feedback when a temperature difference arises.

Note that measuring a temperature of a grinding roll and performing correction control through feedback when a temperature difference arises is disclosed not only in Patent Literature 1 above, but also in Non-Patent Literature 1.

Pages 16 and 17 of Non-Patent Literature 1 include description of an article of roll temperature monitoring under the title of Safety Concept for Roller Mills. This roll temperature monitoring apparatus is provided with a plurality of temperature sensors (multi-point sensors) in a roll-axis direction, and Non-Patent Literature 1 describes "if a set maximum temperature is exceeded or a temperature difference between at least two of the plurality of temperature sensors exceeds 30° C., an alarm is issued," and if "this alarm is issued, a voice signal is issued and a main motor is also stopped."

As seen in Patent Literature 1 above, since a rise of a surface temperature of the roll in the milling roll machine has a large influence on the quality of ground or split products, it is a well-known practice to increase a gap between rolls so as to keep a roll temperature to a set value and correct the temperature or perform correction control through feedback whereby the temperature is corrected through cooling.

Furthermore, as pointed out in Non-Patent Literature 1, a plurality of temperature sensors (multi-point sensors) provided in the roll-axis direction is well known as ones to monitor surface temperatures of rolls.

However, since the temperature sensor is attached to the bearing casing of the roller according to Patent Literature 1 above, it is not possible to accurately detect surface temperatures of rolls. Furthermore, since the roll surfaces are monitored at points according to Non-Patent Literature 1 above, if a high temperature abnormality occurs between the sensors, there is a possibility that the abnormality may be overlooked. Furthermore, since a plurality of multi-point sensors are formed in the roll-axis direction, there is such a problem that if one sensor malfunctions, the roll surface temperature cannot any longer be monitored.

CITATION LIST

Patent Literature

[Patent Literature 1]
Japanese Patent Application Laid-Open No. 53-11757

Non Patent Literature

[Non-Patent Literature 1]
Thomas Heierli, "Advanced & New Technologies in Grain Milling", [online], Oct. 13, 2014 IAOM 2014 Kuala Lumpur, pages 16 and 17, [searched on Aug. 8, 2016], Internet <URL:http://www.iaom.info/content/wp-content/uploads/05buhler.pdf>

SUMMARY OF INVENTION

Technical Problem

In view of the above-described problems, it is an object of the present invention to provide a method and an apparatus for controlling a milling roll machine capable of accurately monitoring a surface temperature of a roll and preventing any high temperature abnormality occurring on a roll surface from being overlooked.

Solution to Problem

An aspect of a method for controlling a milling roll machine according to the present invention provides a technical method which is a method for controlling a milling roll machine provided with at least a pair of rolls in a frame, roll gap adjusting means for driving each of the pair of rolls at different circumferential speeds and adjusting a roll gap between the pair of rolls, and stock supply means for supplying a thin layer of raw material stock between the pair of rolls, in which a non-contact type temperature sensor that monitors both surface temperatures of the pair of rolls and a temperature of a milled product after passing through the rolls is provided in the vicinity of the pair of rolls, and opening/closing control of the roll gap or flow rate control of the raw material stock is performed according to the surface temperatures of the rolls and the temperature of the milled product after passing through the rolls detected by the temperature sensor.

According to the aspect of the present invention, a non-contact type temperature sensor that monitors both surface temperatures of the pair of rolls and a temperature of a milled product after passing through the rolls is provided in the vicinity of the pair of rolls and opening/closing control of the roll gap or flow rate control of the raw material stock is performed according to the surface temperatures of the rolls and the temperature of the milled product after passing through the rolls detected by the temperature sensor, and so it is possible to monitor a temperature in the vicinity of the pair of rolls over a wide region like a bird's eye view using the non-contact type temperature sensor and monitor not only the surface temperatures of the rolls but also the temperature of the milled product after passing through the rolls. That is, abnormality in roll gap or flow rate is determined by associating the surface temperatures of the rolls with the temperature of the milled product after passing through the rolls, roll gap opening/closing control or flow rate control is thereby performed, and so it is possible to accurately monitor the surface temperatures of the rolls and there is also a merit of preventing any high temperature abnormality occurring on the roll surface from being overlooked.

Another aspect of the method for controlling a milling roll machine according to the present invention is to perform opening/closing control of the roll gap or flow rate control of the raw material stock according to a temperature of a raw material before passing through the rolls detected by the temperature sensor.

According to the other aspect of the present invention, since opening/closing control of the roll gap or flow rate control of the raw material stock is performed according to a temperature of the raw material before passing through the rolls detected by the temperature sensor, it is possible to calculate a temperature difference between the temperature of raw material grain before passing through the rolls and the temperature of the milled product after passing through the rolls, and control the roll gap or flow rate so as to prevent the temperature difference from exceeding a predetermined value. This makes it possible to prevent degradation of quality of the product due to a high temperature.

An aspect of a control apparatus for a milling roll machine according to the present invention is a control apparatus for a milling roll machine provided with at least a pair of rolls in a frame, roll gap adjusting means for driving each of the pair of rolls at different circumferential speeds and adjusting a roll gap between the pair of rolls, and stock supply means for supplying a thin layer of raw material stock between the pair of rolls, in which in the vicinity of the pair of rolls, the control apparatus provides a non-contact type temperature sensor that monitors both surface temperatures of the pair of rolls and a temperature of a milled product after passing through the rolls, and control means for performing opening/closing control of the roll gap or flow rate control of the raw material stock according to the surface temperatures of the rolls and the temperature of the milled product after passing through the rolls detected by the temperature sensor.

Another aspect of the control apparatus for a milling roll machine according to the present invention is that the control means performs opening/closing control of the roll gap or flow rate control of the raw material stock according to the temperature of the raw material stock before passing through the rolls detected by the temperature sensor.

A further aspect of the control apparatus for a milling roll machine according to the present invention is that the temperature sensor is a non-contact type thermography camera that detects infrared radiation energy radiated from an object to be detected and can visualize the energy.

A still further aspect of the control apparatus for a milling roll machine according to the present invention is that the thermography camera is provided in plurality on upper and lower sides of the pair of rolls.

A still further aspect of the control apparatus for a milling roll machine according to the present invention is that the thermography camera is formed of illumination means made up of a plurality of LED lamps, an infrared area sensor that detects infrared radiation energy radiated from an object, a CCD area sensor that forms an image of light emitted from the object on a light receiving plane of an image pickup device and a fish-eye lens covering the infrared area sensor and the CCD area sensor.

A still further aspect of the control apparatus for a milling roll machine according to the present invention is that the thermography camera is formed of an infrared area sensor that detects infrared radiation energy radiated from an object and a fish-eye lens covering the infrared area sensor.

According to the above-described other aspects, the non-contact type temperature sensor is preferably a non-contact type thermography camera that detects infrared radiation energy radiated from the object to be detected and can visualize the energy, and particularly when the non-contact type temperature sensor is formed of illumination means made up of a plurality of LED lamps, an infrared area sensor that detects infrared radiation energy radiated from the object, a CCD area sensor that forms an image of light emitted from the object onto a light-receiving plane of the image pickup device and a fish-eye lens covering the infrared area sensor and the CCD area sensor, it is possible to grasp a temperature distribution through the infrared area sensor and grasp a shape of the object through the CCD area sensor. The fish-eye lens allows a wide region to be monitored like a bird's eye view.

Advantageous Effects of Invention

The present invention can provide a method and an apparatus for controlling a milling roll machine capable of accurately monitoring a surface temperature of a roll and preventing any high temperature abnormality occurring on the roll surface from being overlooked.

DESCRIPTION OF EMBODIMENTS

Hereinafter, an embodiment of the present invention will be described with reference to the accompanying drawings.

Figure 1:
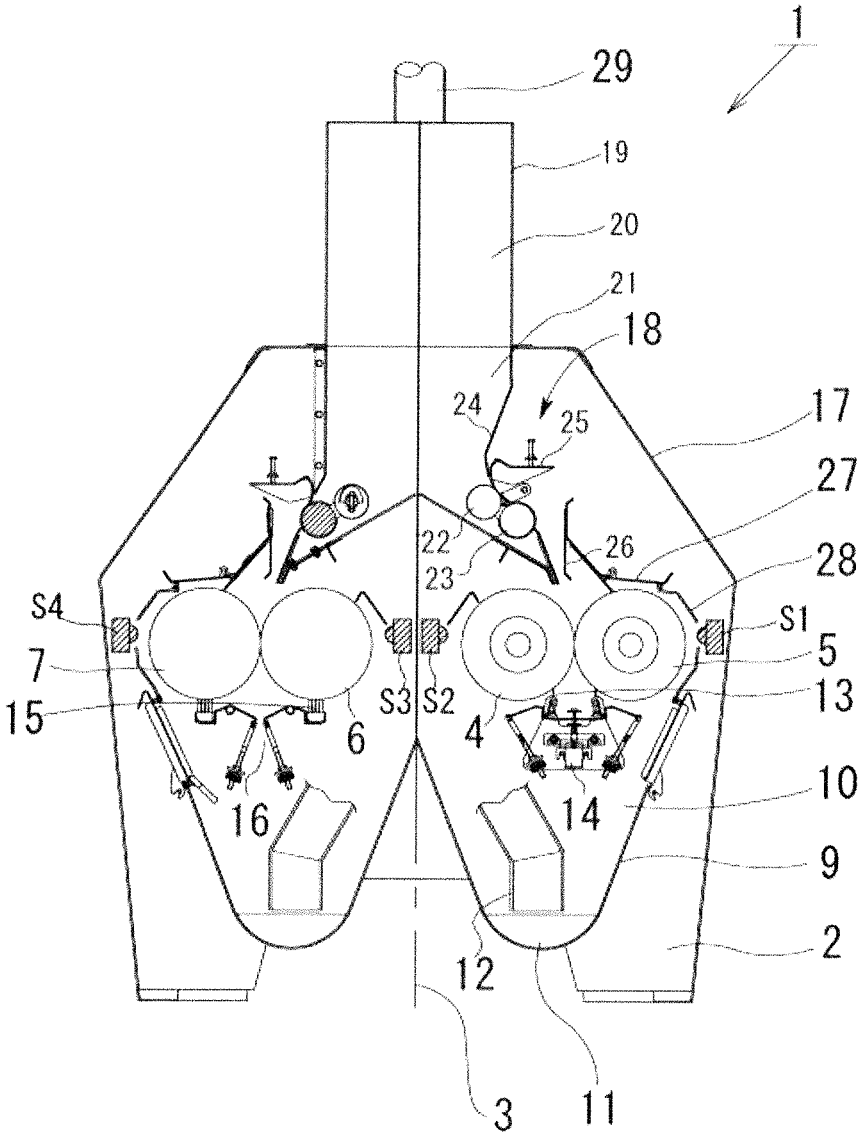
FIG. 1 is a cross-sectional view of a double milling roll machine of the present invention.
Figure 2:
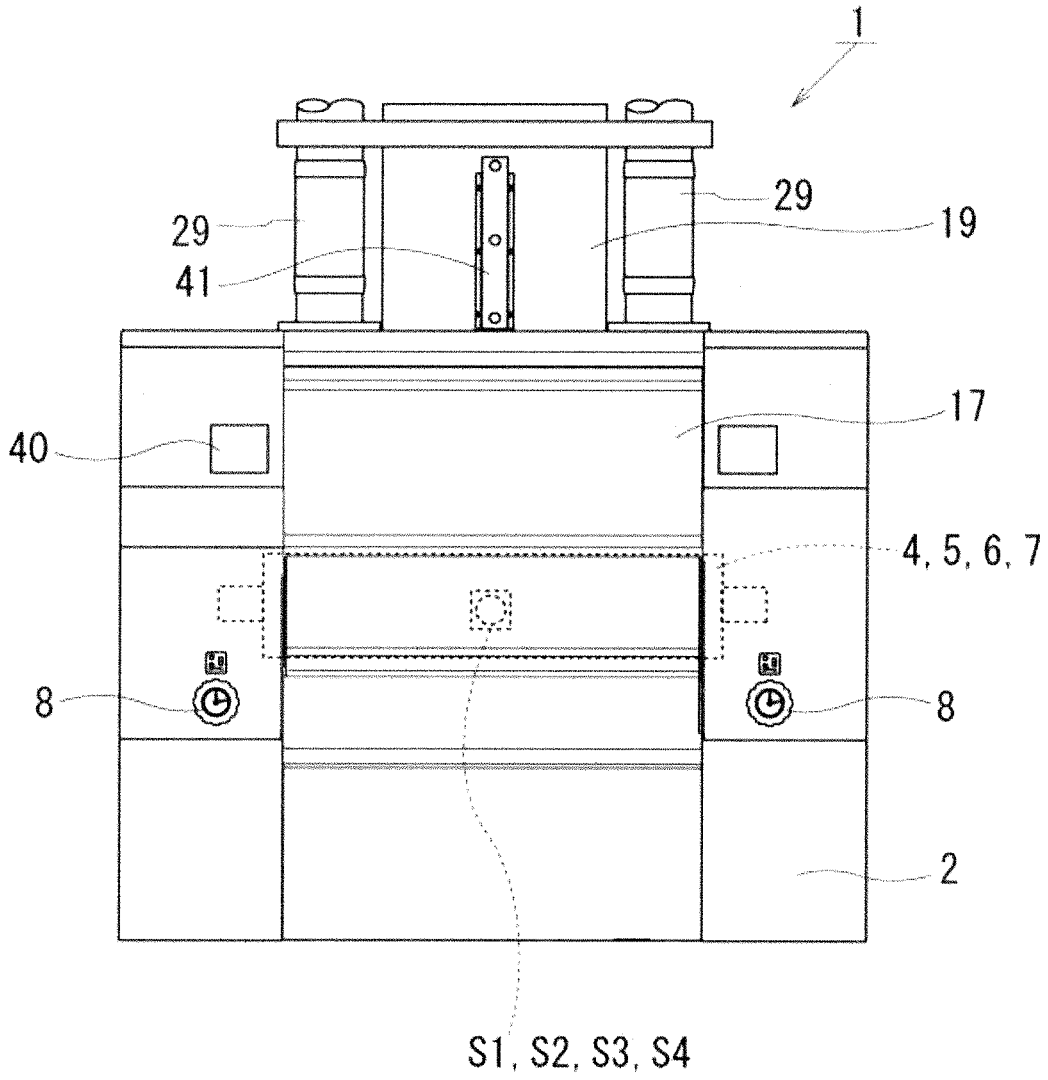
FIG. 2 is a front view of the milling roll machine in FIG. 1.

FIG. 1 is a cross-sectional view of a double milling roll machine and FIG. 2 is a front view of the milling roll machine in FIG. 1. In FIG. 1 and FIG. 2, reference numeral 1 denotes a milling roll machine, one frame 2 is partitioned at the center by a partition plate 3 or the like, providing a pair of main rolls 4 and 5, and a pair of main rolls 6 and 7 symmetrically. The pair of main rolls 4 and 5, and the pair of main rolls 6 and 7 are formed integrally as a pack, and the main rolls 4 and 5 come with a bearing, a housing, a seal, a spring, a roll gap adjusting apparatus or the like enabled to facilitate replacement of rolls (e.g., see Japanese Patent Publication No. 3562541).

The main rolls 4 and 6 closer to the partition plate 3 of the frame 2 are supported by movable bearings and the main rolls 5 and 7 closer to the frame 2 side are rotatably supported by fixed bearings, and the main rolls 4 and 6 on the movable bearing side may be formed as low-speed rolls and the main rolls 5 and 7 on the fixed bearing side may be formed as high-speed rolls in order to drive the respective rolls at different circumferential speeds. Furthermore, if roll gap adjusting apparatuses (not shown) are interposed between the pair of main rolls 4 and 5, and between the pair of main rolls 6 and 7, it is possible to manually finely adjust roll gaps by turning a handle 8 (see FIG. 2).

A lower part of a grinding chamber 10 surrounded by a cover 9 below the main rolls 4 and 5 is designated as a discharging hopper 11 and a transporting pipe 12 for transporting a stock after grinding is placed so as to face into the discharging hopper 11. Furthermore, scrapers 13 for scraping stock adhering to the pair of main rolls 4 and 5 are respectively provided in the grinding chamber 10. The scrapers 13 are kept in contact with surfaces of the main rolls 4 and 5 by a support body 14. In a case where the pair of main rolls 6 and 7 are dressing rolls, brushes 15 are provided instead of scrapers. The brushes 15 are kept in contact with surfaces of the main rolls 6 and 7 by a support body 16.

A front door 17 is provided on a diagonally upward side of the main rolls 4 and 5, and stock supply means 18 is provided between the front door 17 and the partition plate 3. The stock supply means 18 is constructed of a stock supply chamber 20 formed of a stock supply cylinder 19, a supply hopper 21 communicating with the stock supply chamber 20, a pair of front and back feed rolls 22 and 23 provided to supply a thin layer of stock to the milling rolls, a feeder gate plate 24 located above the front-side feed roll 22 of the pair of feed rolls 22 and 23, a guide plate 25 provided on a side of the supply hopper 21, and a guide chute 26 that causes the thin layer stock discharged from the pair of feed rolls 22 and 23 to flow down to the main rolls 4 and 5 for milling.

Outer circumferences of the pair of main rolls 4 and 5 are covered with a plurality of roll covers. That is, the main rolls 4 and 5 are covered with a top cover 27 and an outside cover 28. A pneumatic pipe 29 that transports the stock after grinding by the milling roll machine 1 to a subsequent process is disposed at a vertex of the stock supply cylinder 19.

The main rolls 4 and 5 are provided with sensors S for monitoring surface temperatures of the main rolls 4 and 5 or monitoring temperatures of milled products (grain) passing through the main rolls 4 and 5. As the sensors S, it is preferable to dispose a sensor S1 in a gap between the outside cover 28 and the frame 2 for monitoring the main roll 5 side, a sensor S2 in the vicinity of the partition plate 3 for monitoring the main roll 4 side, a sensor S3 in the vicinity of the partition plate 3 for monitoring the main roll 6 side, and a sensor S4 in a gap between the outside cover and the frame 2 for monitoring the main roll 7 side.

For example, a thermography camera may be preferably used as the sensors S for monitoring the surface temperatures of the rolls or monitoring temperatures of the milled products passing through the rolls. The "thermography camera" refers to an apparatus that detects infrared radiation energy radiated from an object to be detected, enables visualization and performs temperature measurement and image display of temperature distribution. The thermography camera has a variety of advantages: a wide range of monitoring region, ability to safely perform measurement even in dangerous places, ability to perform measurement even in places where it is not possible to use a contact type thermometer such as a thermocouple, and ability to perform measurement even in the dark.

When used for the milling roll machine 1 of the present embodiment, the thermography camera can display images with a temperature distribution over an entire region in the axial direction for even lengthy rolls having a length on the order of 1000 mm to 1500 mm. The thermography camera can also simultaneously display images of temperature distributions of four kinds of temperatures: a temperature of raw material grain located above the roll and before passing through the roll, a temperature of a milled product nearest to the roll and when passing through the roll, and a temperature of a milled product located below the roll and after passing through the role in addition to a surface temperature of the roll. This will greatly contribute to quality management of products.

Figure 3:
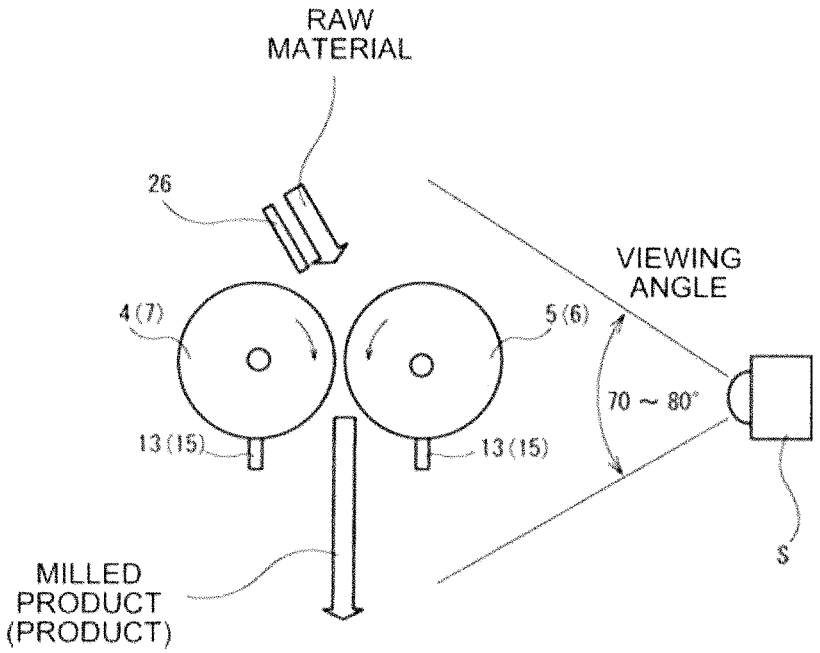
FIG. 3 is a schematic view illustrating an arrangement configuration of sensors S that simultaneously monitor surface temperatures of rolls and a temperature of grain passing through the rolls.
Figure 4:
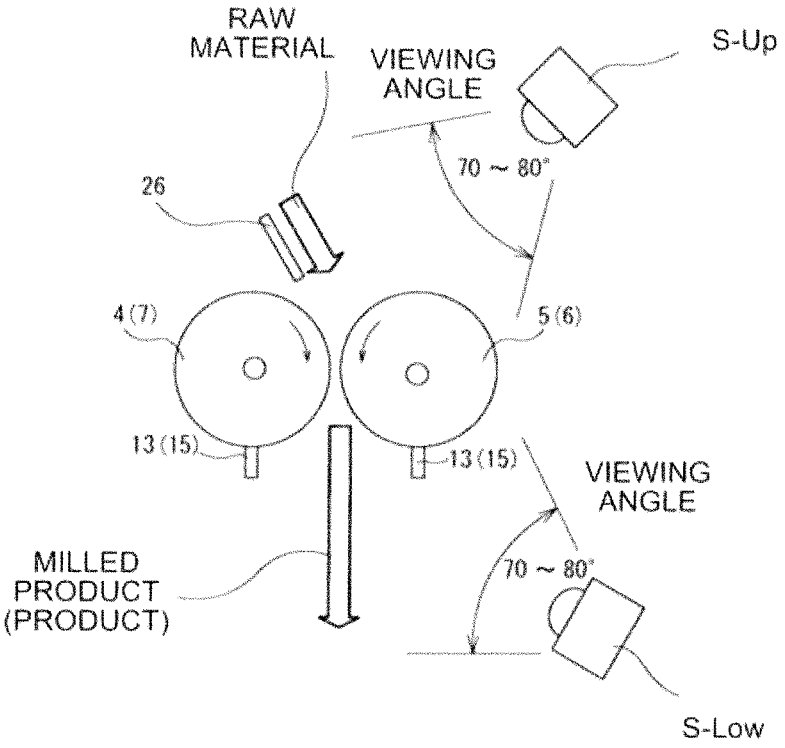
FIG. 4 is a schematic view of another example of the milling roll machine.

FIG. 3 and FIG. 4 are schematic views illustrating an arrangement configuration of the sensors S when monitoring surface temperatures of the rolls simultaneously with a temperature of grain passing through the rolls.

Referring to FIG. 3, since the sensors S are arranged on the sides of (just beside) the main rolls 4 and 5, and viewing angles of the sensors S range from substantially 70 to 80°, it is possible to acquire four kinds of temperatures: temperature at the roll surface, temperature of the raw material grain, temperature of the milled product while passing through the roll and temperature of the milled product after passing through the rolls. Since only one sensor needs to be disposed for the pair of rolls 4 and 5, it is possible to reduce the manufacturing cost.

Referring to FIG. 4, a sensor S-Up is disposed diagonally above the main rolls 4 and 5 and a sensor S-Low is disposed diagonally below the main rolls 4 and 5. In this way, the sensor S-Up is responsible for monitoring the temperature on the top side of the roll surface and the temperature region of raw material grain, while the sensor S-Low is responsible for monitoring the temperature region of the milled product after passing through the rolls. Since the two sensors S-Up and S-Low share monitoring of the temperature region, it is possible to obtain a more accurate and more detailed temperature distribution.

Figure 5A:
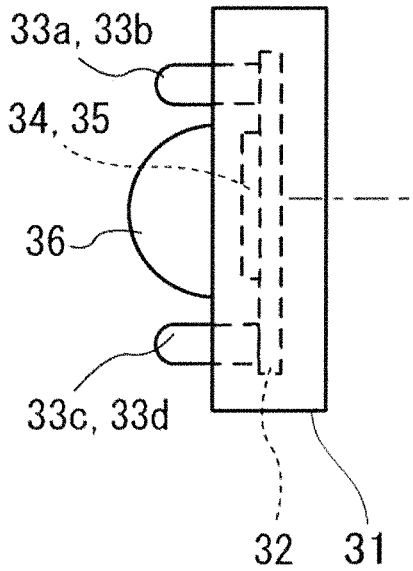
FIG. 5A is a schematic configuration diagram of a side of a thermography camera.
Figure 5B:
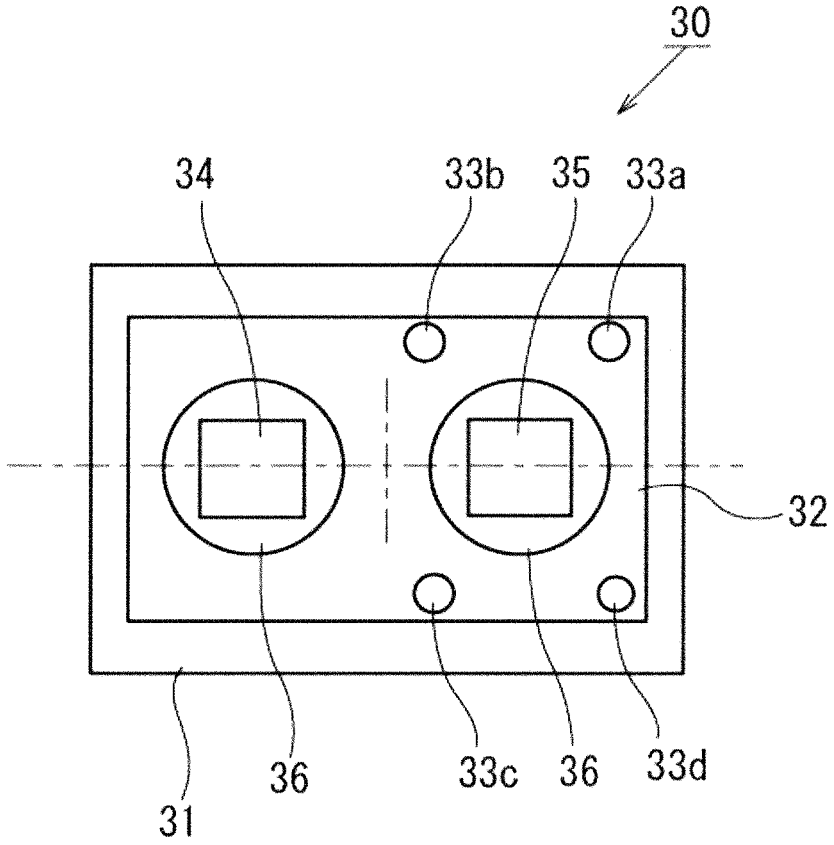
FIG. 5B is a schematic configuration diagram of a front side of the thermography camera.
Figure 6A:
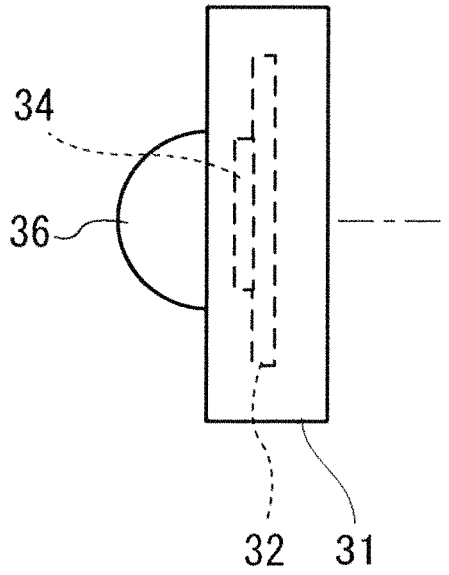
FIG. 6A is a schematic configuration diagram of a side of a thermography camera illustrating another example of the milling roll machine.
Figure 6B:
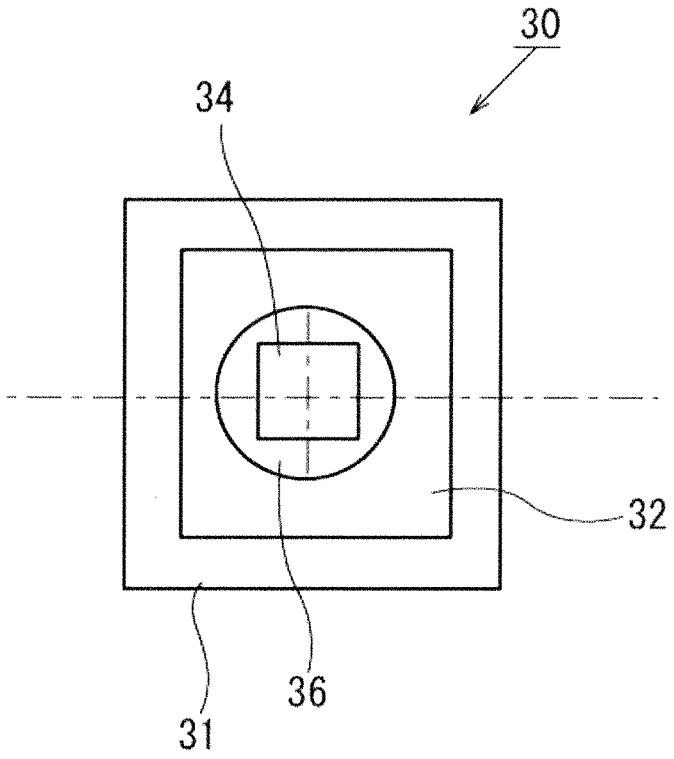
FIG. 6B is a schematic configuration diagram of a front side of the thermography camera illustrating another example of the milling roll machine.

FIGS. 5A and 5B, and FIGS. 6A and 6B are schematic configuration diagrams of the thermography camera applied to the milling roll machine 1 of the present invention. FIGS. 5A and 5B in particular, illustrate a high function type configuration provided with an infrared area sensor, a CCD area sensor and a light source LED lamp, and FIGS. 6A and 6B illustrate an inexpensive configuration provided with only an infrared area sensor.

FIG. 5A is a schematic configuration diagram of a lateral side of the thermography camera and FIG. 5B is a schematic configuration diagram of a front side. Referring to FIGS. 5A and 5B, the thermography camera 30 is constructed of a plurality of LED lamps 33*a* to 33*d* which serve as illumination means, an infrared area sensor 34 that detects infrared radiation energy radiated from an object, a CCD area sensor 35 that forms an image of light emitted from the object on a light receiving surface of an image pickup device and a fish-eye lens 36 covering the infrared area sensor 34 and the CCD area sensor 35, all of which are mounted on a camera drive substrate 32 incorporated in the camera case 31.

As shown in FIGS. 5A and 5B, the high function type thermography camera 30 provided with the infrared area sensor 34, the CCD area sensor 35 and the LED lamps 33 can grasp a temperature distribution through the infrared area sensor 34, grasp the shape of the object through the CCD area sensor 35, and it is thereby possible to instantaneously grasp which region of the object has a high or low temperature using an image synthesis technique.

Figure 8:
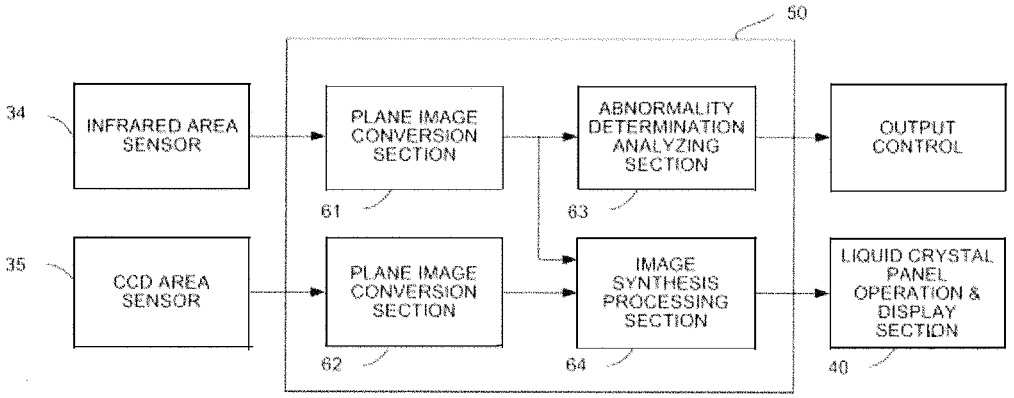
FIG. 8 is a block diagram when performing image determination processing on an image of the thermography camera.

FIG. 8 is a block diagram of the high function type thermography camera shown in FIGS. 5A and 5B when performing image determination processing. Referring to FIG. 8, the infrared area sensor 34 and the CCD area sensor 35 are electrically connected to plane image conversion sections 61 and 62 in a central computation control apparatus 50 respectively. That is, these sensors are covered with the fish-eye lens 36 and thereby provide equidistant projection images taken with a wide viewing angle, and the plane image conversion sections 61 and 62 are used to convert the equidistant projection images to plane images. An electric signal from the plane image conversion section 61 on the infrared area sensor 34 side is inputted to an abnormality determination analyzing section 63 and also inputted to an image synthesis processing section 64, and on the other hand, an electric signal from the plane image conversion section 62 on the CCD area sensor 35 side is only inputted to the image synthesis processing section 64. Here, the abnormality determination analyzing section 63 can determine an abnormality in the roll gap or flow rate through a temperature distribution, a temperature difference or the like in the region of an object which will be described later. Furthermore, the image synthesis processing section 64 can grasp the shape of the object through the CCD area sensor 35 and at the same time can grasp which region of the object has a high or low temperature through the infrared area sensor 34. The output of an electric signal from the abnormality determination analyzing section 63 is controlled, by various actuators which will be described later and an electric signal from the image synthesis processing section 64 is outputted to an operation & display section 40 provided with a liquid crystal screen which will be described later.

On the other hand, FIG. 6A is a schematic configuration diagram of the lateral side of the thermography camera provided with only the infrared area sensor and FIG. 6B is a schematic configuration diagram of the front side. Referring to FIGS. 5A and 5B, the thermography camera 30 is constructed of the infrared area sensor 34 and the fish-eye lens 36 covering the infrared area sensor 34 on the camera drive substrate 32 incorporated in the camera case 31.

As shown in FIGS. 6A and 6B, the inexpensive type thermography camera 30 provided with only the infrared area sensor 34 makes it possible to instantaneously grasp which region of the object has a high or low temperature by defining the shape of the object in advance and performing sensing, and can be provided at low cost.

Figure 7:
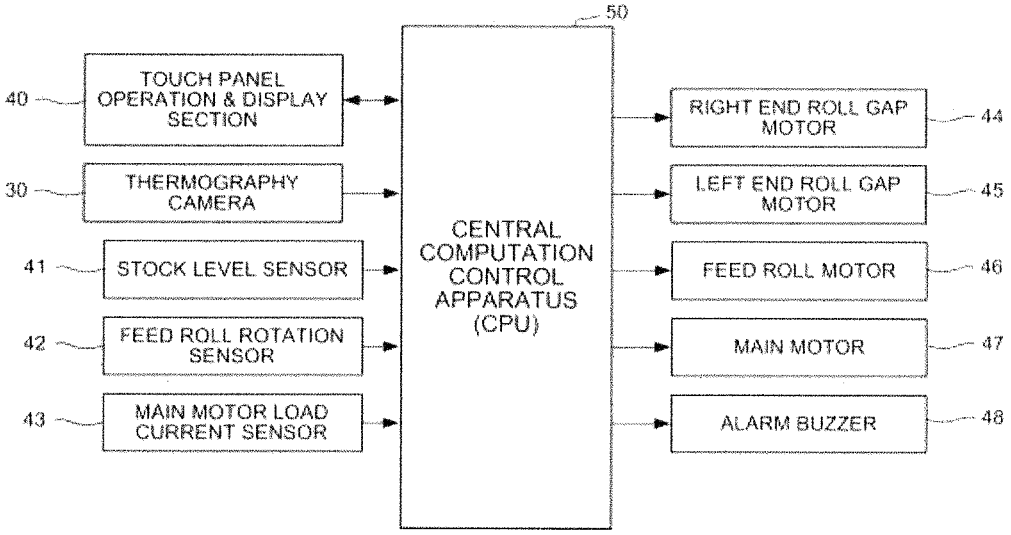
FIG. 7 is a block diagram illustrating a control configuration of the milling roll machine.

FIG. 7 is a block diagram illustrating a control configuration of the milling roll machine provided with the thermography camera of the present invention.

As shown in FIG. 1, FIG. 2 and FIG. 7, the control configuration of the milling roll machine includes an operation & display section 40 incorporated in the frame 2 of the milling roll machine and made operable by directly touching a liquid crystal screen and the thermography camera 30, both of which constitute a main input section, and are electrically connected to the central computation control apparatus 50. Other input sections include a stock level sensor 41, a feed roll rotation sensor 42 and a main motor load current sensor 43, which are electrically connected to the central computation control apparatus 50.

On the other hand, the output section is constructed of a right end roll gap motor 44 that automatically adjusts the gap on one end side of the main rolls 4 and 5, a left end roll gap motor 45 that automatically adjusts the gap on the other end side of the main rolls 4 and 5, a feed roll motor 46, a main motor 47 and an alarm buzzer 48, all of which are electrically connected to the central computation control apparatus 50. Various actuators can thereby be operated.

Hereinafter, operations in the above-described configuration will be described with reference to the attached drawings.

Figure 9:
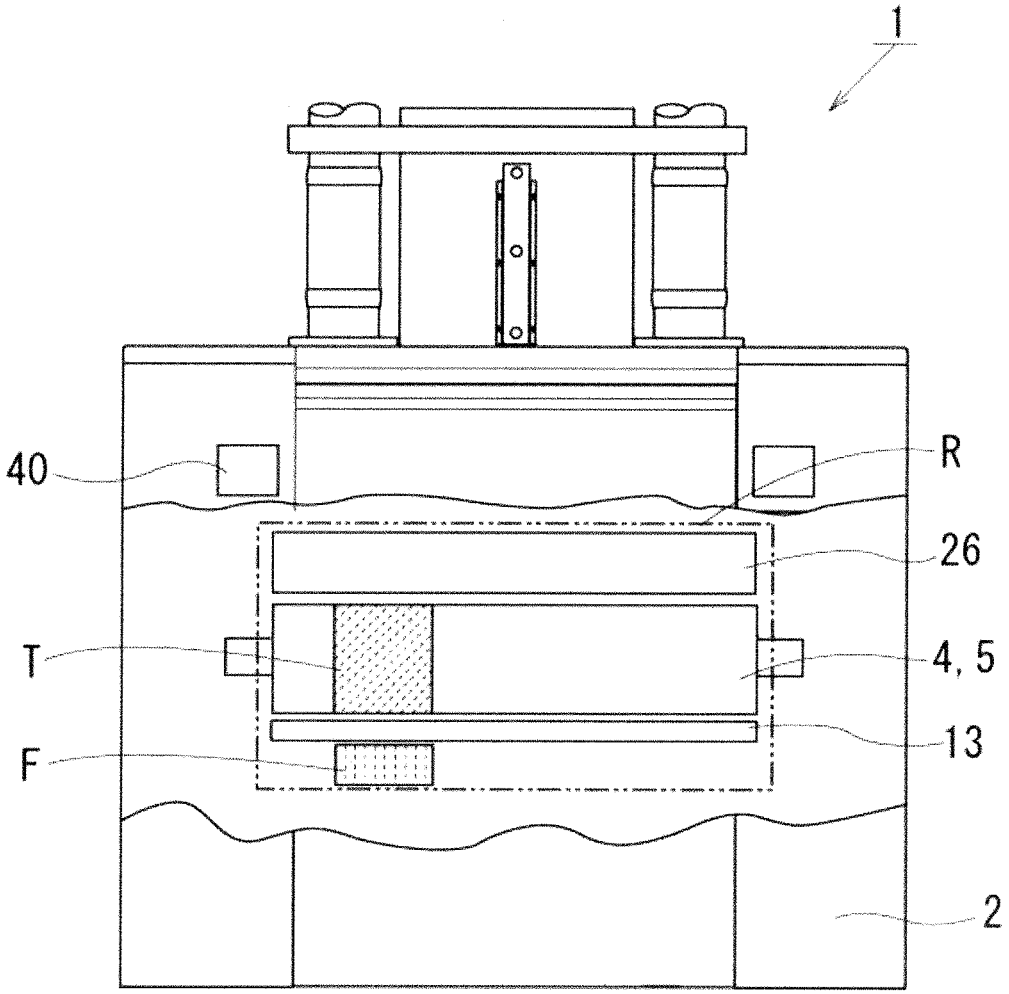
FIG. 9 is an explanatory diagram illustrating FIG. 2 partially exploded such that the vicinity of the rolls is exposed.
Figure 10:
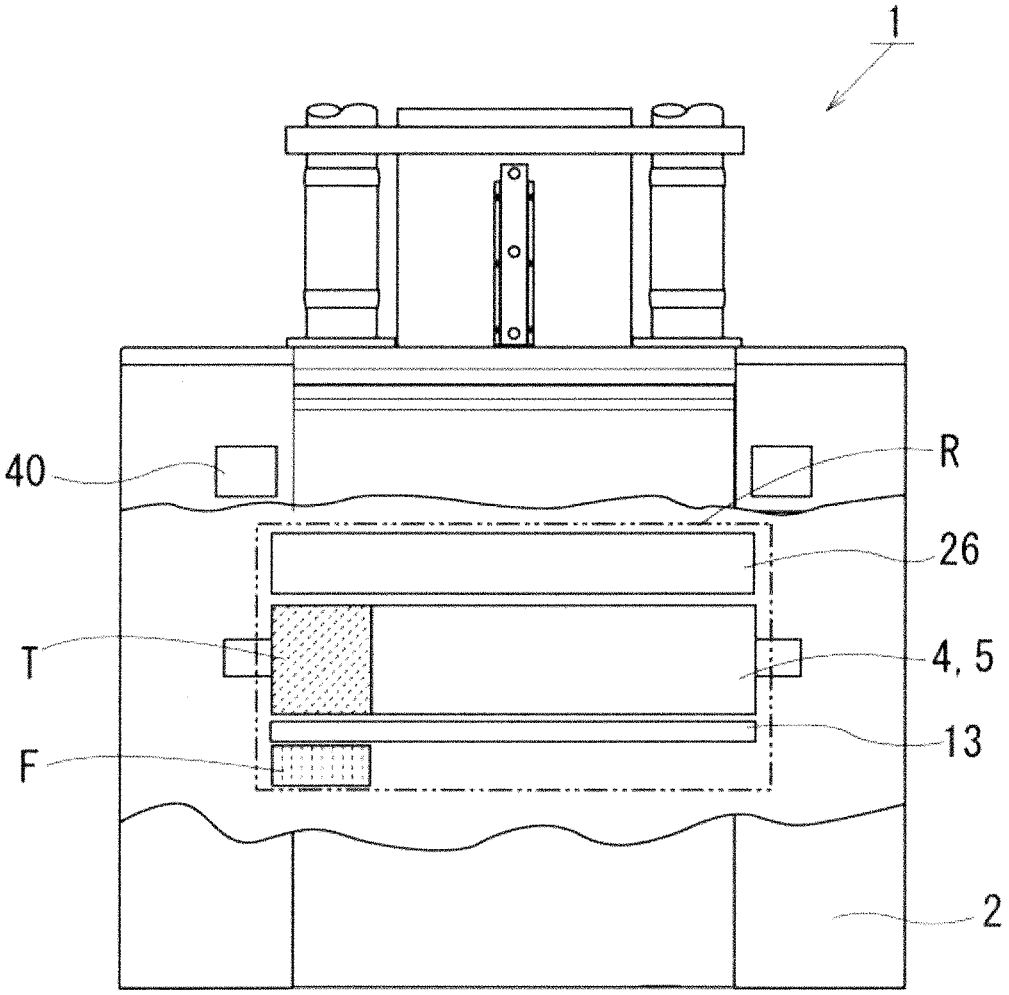
FIG. 10 is a diagram illustrating another example of the milling roll machine.

FIG. 9 and FIG. 10 are explanatory diagrams illustrating the front view in FIG. 2 partially exploded such that the vicinity of the main rolls 4 and 5 is exposed.

In FIG. 9, an observation region by the thermography camera 30 is denoted by reference character R, and the thermography camera 30 acquires three temperatures: surface temperatures of the main rolls 4 and 5, a temperature of a milled product while passing through the rolls, and a temperature of the milled product after passing through the rolls. Suppose that a situation has been detected by the thermography camera 30 in which a surface temperature at a specific location T of the main rolls 4 and 5 is lower than a peripheral temperature and a temperature of a milled product F below the main rolls 4 and 5 is also lower than the peripheral temperature. In this case, it is recognized that the raw material is not flowing uniformly in the axial direction of the main rolls 4 and 5. That is, it can be assumed that the raw material is not flowing only through the specific location T resulting in a biased flow. At this time, the alarm buzzer 48 may be sounded as a roll gap abnormality and an abnormality cause may be displayed on the liquid crystal screen of the operation & display section 40. The roll gap abnormality is, for example, a state in which the main rolls 4 and 5 are not parallel to each other and the right end or left end is open in a "truncated chevron" shape. Since the milling roll is a lengthy roll having a length on the order of 1000 mm to 1500 mm, a biased flow of the raw material is generated even when there is a slight difference in the gap at the right end or left end.

Therefore, the central computation control apparatus 50 drives the right end roll gap motor 44 or the left end roll gap motor 45 and performs automatic control so that the roll gap becomes appropriate. Without being limited to such automatic control, the operator may determine a cause for the abnormality displayed on the liquid crystal screen, operate the handles 8, 8 to manually adjust the roll gap to an appropriate value.

Furthermore, in FIG. 10, suppose that the thermography camera 30 detects a situation in which the surface temperature at the specific location T at the left end of the main rolls 4 and 5 is higher than a peripheral temperature and the temperature of the milled product F below the main rolls 4 and 5 is also higher than the peripheral temperature. In this case, it is assumed that the roll gap at the specific location T is narrow, the roll gap at the right end of the main rolls 4 and 5 is wide ("truncated chevron" shape as described above), and the raw material is not flowing uniformly in the axial direction of the main rolls 4 and 5. At this time, the alarm buzzer 48 may be sounded as a roll gap abnormality and an abnormality cause may be displayed on the liquid crystal screen of the operation & display section 40. In this way, the central computation control apparatus 50 drives the right end roll gap motor 44 or the left end roll gap motor 45 and performs automatic control so that the roll gap becomes appropriate. Without being limited to this, the operator may determine a cause for the abnormality displayed on the liquid crystal screen, operate the handles 8, 8 to manually adjust the roll gap to an appropriate value.

In addition, of the observation region R, the thermography camera 30 may monitor only the temperature of the milled product after passing through the rolls. That is, the thermography camera 30 may control the roll gap or the flow rate so that the temperature of the milled product after passing through the rolls becomes uniform and the temperature of the milled product does not become excessively high. For example, when the thermography camera 30 detects that the temperature of the milled product exceeds 50° C., the roll gap may be controlled to an appropriate value or control may be performed to suppress the flow rate. The flow rate control may be enabled by controlling rotation of the feed roll motor 46. This makes it possible to prevent degradation of quality of the product due to a high temperature and obtain a product resulting from uniformly milling the raw material. Moreover, the yield in a post process will also improve and milling efficiency will improve, which leads to energy saving as well.

Furthermore, of the observation region R, the thermography camera 30 may monitor a temperature of the raw material grain above the rolls and before passing through the rolls and a temperature of the milled product after passing through the rolls. That is, the thermography camera 30 may calculate a temperature difference between the temperature of the raw material grain before passing through the rolls and the temperature of the milled product after passing through the rolls, and control the roll gap or flow rate so as to prevent the temperature difference from exceeding a predetermined value. This makes it possible to prevent degradation of quality of the product due to a high temperature.

As described above, according to the present embodiment, the non-contact type temperature sensor S for monitoring both the surface temperature of the pair of main rolls 4 and 5 and the temperature of the milled product after passing through the rolls is provided in the vicinity of the pair of main rolls 4 and 5, and opening/closing control of the roll gap or flow rate control of the raw material stock is performed according to the surface temperatures of the rolls and the temperature of the milled product after passing through the rolls detected by the temperature sensor S, and therefore it is possible to monitor the temperature in the vicinity of the pair of rolls over a wide region like a bird's eye view using the non-contact type temperature sensor S and monitor not only the surface temperatures of the rolls but also the temperature of the milled product after passing through the rolls. That is, since an abnormality in the roll gap or flow rate is determined by associating the surface temperatures of the rolls with the temperature of the milled product after passing through the rolls, and opening/closing control of the roll gap or flow rate control is thereby performed, there is a merit that it is possible to accurately monitor the surface temperatures of the rolls and prevent any high temperature abnormality occurring on a roll surface from being overlooked.

INDUSTRIAL APPLICABILITY

The present invention is applicable to a milling roll machine.

REFERENCE SIGNS LIST

1 Milling roll machine
2 Frame
3 Partition plate
4 Main roll
5 Main roll
6 Main roll
7 Main roll
8 Handle
9 Cover
10 Grinding chamber
11 Discharging hopper
12 Transporting pipe
13 Scraper
14 Support body
15 Brushes
16 Support body
17 Front door
18 Stock supply means
19 Stock supply cylinder
20 Stock supply chamber
21 Supply hopper
22 Feed roll
23 Feed roll
24 Feeder gate plate
25 Guide plate
26 Guide chute
27 Top cover
28 Outside cover
29 Pneumatic pipe
30 Thermography camera
31 Camera case
32 Camera drive substrate
33 LED lamp
34 Infrared area sensor
35 CCD area sensor
36 Fish-eye lens
40 Operation & display section
41 Stock level sensor
42 Feed roll rotation sensor
43 Main motor load current sensor

44 Right end roll gap motor
45 Left end roll gap motor
46 Feed roll motor
47 Main motor
48 Alarm buzzer
50 Central computation control apparatus
61 Plane image conversion section
62 Plane image conversion section
63 Abnormality determination analyzing section
64 Image synthesis processing section

The invention claimed is:

1. A method for controlling a milling roll machine comprising:

a pair of rolls in a frame;

a roll gap adjusting mechanism for driving each of the pair of rolls at different circumferential speeds and adjusting a roll gap between the pair of rolls; and a stock supply mechanism for supplying a thin layer of raw material stock between the pair of rolls, wherein a non-contact temperature sensor that monitors both surface temperatures of the pair of rolls and a temperature of a milled product after passing through the pair of rolls is provided in a vicinity of the pair of rolls, and opening/closing control of the roll gap or flow rate control of the raw material stock is performed according to the surface temperatures of the pair of rolls and the temperature of the milled product after passing through the pair of rolls detected by the non-contact temperature sensor.

2. The method for controlling a milling roll machine according to claim 1, wherein opening/closing control of the roll gap or flow rate control of the raw material stock is performed according to a temperature of the raw material stock before passing through the pair of rolls detected by the non-contact temperature sensor.

3. A control apparatus for a milling roll machine comprising:

a pair of rolls in a frame;

a roll gap adjusting mechanism for driving each of the pair of rolls at different circumferential speeds and adjusting a roll gap between the pair of rolls; and a stock supply mechanism for supplying a thin layer of a raw material stock between the pair of rolls, wherein, in the vicinity of the pair of rolls, the control apparatus comprises:

a non-contact temperature sensor that monitors both surface temperatures of the pair of rolls and a temperature of a milled product after passing through the pair of rolls; and a control unit for performing opening/closing control of the roll gap or flow rate control of the raw material stock according to the surface temperatures of the pair of rolls and the temperature of the milled product after passing through the pair of rolls detected by the non-contact temperature sensor.

4. The control apparatus for a milling roll machine according to claim 3, wherein the control unit performs opening/closing control of the roll gap or flow rate control of the raw material stock according to the temperature of the raw material stock before passing through the pair of rolls detected by the non-contact temperature sensor.

5. The control apparatus for a milling roll machine according to claim 4, wherein the non-contact temperature sensor is a non-contact thermography camera that detects infrared radiation energy radiated from an object to be detected and can visualize the energy.

6. The control apparatus for a milling roll machine according to claim 3, wherein the non-contact temperature sensor is a non-contact thermography camera that detects infrared radiation energy radiated from an object to be detected and can visualize the energy.

7. The control apparatus for a milling roll machine according to claim 6, wherein the thermography camera is provided in plurality on upper and lower sides of the pair of rolls.

8. The control apparatus for a milling roll machine according to claim 7, wherein the thermography camera is formed of illumination unit comprising a plurality of LED lamps, an infrared area sensor that detects infrared radiation energy radiated from an object, a CCD area sensor that forms an image of light emitted from the object on a light receiving plane of an image pickup device and a fish-eye lens covering the infrared area sensor and the CCD area sensor.

9. The control apparatus for a milling roll machine according to claim 7, wherein the thermography camera is formed of an infrared area sensor that detects infrared radiation energy radiated from an object and a fish-eye lens covering the infrared area sensor.

10. The control apparatus for a milling roll machine according to claim 6, wherein the thermography camera is formed of illumination unit comprising a plurality of LED lamps, an infrared area sensor that detects infrared radiation energy radiated from an object, a CCD area sensor that forms an image of light emitted from the object on a light receiving plane of an image pickup device and a fish-eye lens covering the infrared area sensor and the CCD area sensor.

11. The control apparatus for a milling roll machine according to claim 6, wherein the thermography camera is formed of an infrared area sensor that detects infrared radiation energy radiated from an object and a fish-eye lens covering the infrared area sensor.

* * * * *